US010758789B2

(12) United States Patent
Bacon et al.

(10) Patent No.: US 10,758,789 B2
(45) Date of Patent: Sep. 1, 2020

(54) GOLF CLUB HEAD WITH VARIABLE FACE THICKNESS

(71) Applicant: KARSTEN MANUFACTURING CORPORATION, Phoenix, AZ (US)

(72) Inventors: Cory S. Bacon, Cave Creek, AZ (US); Eric J. Morales, Laveen, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/230,944

(22) Filed: Dec. 21, 2018

(65) Prior Publication Data

US 2019/0192927 A1 Jun. 27, 2019

Related U.S. Application Data

(60) Provisional application No. 62/757,925, filed on Nov. 9, 2018, provisional application No. 62/610,074, filed on Dec. 22, 2017.

(51) Int. Cl.
*A63B 53/04* (2015.01)
*A63B 53/08* (2015.01)

(52) U.S. Cl.
CPC ..... *A63B 53/0466* (2013.01); *A63B 53/08* (2013.01); *A63B 2053/0412* (2013.01); *A63B 2053/0458* (2013.01)

(58) Field of Classification Search
CPC ..... A63B 53/0466; A63B 53/08; A63B 2053/0458; A63B 2053/0412
See application file for complete search history.

(56) References Cited

U.S. PATENT DOCUMENTS

| | | | | |
|---|---|---|---|---|
| 5,971,868 | A | 10/1999 | Kosmatka | |
| 6,319,150 | B1 | 11/2001 | Werner | |
| 6,368,234 | B1 | 4/2002 | Galloway | |
| 6,478,693 | B2 * | 11/2002 | Matsunaga | A63B 53/04 473/345 |
| 6,508,722 | B1 * | 1/2003 | McCabe | A63B 53/04 473/330 |
| 6,679,786 | B2 * | 1/2004 | McCabe | A63B 53/02 473/305 |
| 6,841,014 | B2 | 1/2005 | Huang | |
| 6,904,663 | B2 | 6/2005 | Willett | |
| 7,014,570 | B2 | 3/2006 | Evans | |

(Continued)

FOREIGN PATENT DOCUMENTS

| | | |
|---|---|---|
| JP | 2880109 | 6/1997 |
| JP | 2002239040 A * | 8/2002 |

(Continued)

*Primary Examiner* — Stephen L Blau

(57) ABSTRACT

Embodiments of golf club heads comprising a face with a variable thickness to improve the durability in the club head, increase ball speed, and increase characteristic time (CT) are described herein. The face comprises thickened and thinned regions. The face includes a perimeter thickened region positioned near a perimeter of the face, a thinned region positioned inward of the perimeter thickened region toward a center of the face, and a central thickened region positioned over the center of the face. The combination of the thickened and thinned regions of the face increase ball speed and further increase or maximize CT without sacrificing durability.

13 Claims, 12 Drawing Sheets

(56) References Cited

U.S. PATENT DOCUMENTS

| | | | | |
|---|---|---|---|---|
| 7,018,303 | B2 | 3/2006 | Yamamoto | |
| 7,018,305 | B2 | 3/2006 | Sugimoto | |
| 7,066,833 | B2 | 6/2006 | Yamamoto | |
| 7,126,339 | B2 | 10/2006 | Nagai | |
| 7,144,337 | B2 | 12/2006 | Hirano | |
| 7,207,898 | B2 | 4/2007 | Rice | |
| 7,278,925 | B2 | 10/2007 | Oyama | |
| 7,347,794 | B2 | 3/2008 | Schweigert | |
| 7,435,189 | B2 | 10/2008 | Hirano | |
| 7,585,232 | B2 | 9/2009 | Krumme | |
| 7,614,964 | B2 | 11/2009 | Matsunaga | |
| 7,658,687 | B2 * | 2/2010 | Hirano | A63B 53/0466 473/345 |
| 7,744,486 | B2 | 6/2010 | Hou | |
| 7,753,808 | B2 | 7/2010 | Matsunaga | |
| 7,780,547 | B2 * | 8/2010 | Ban | A63B 53/0466 473/324 |
| 8,047,931 | B2 | 11/2011 | Yokota | |
| 8,272,975 | B2 | 9/2012 | Morin | |
| 8,277,334 | B2 | 10/2012 | Meyer | |
| 8,382,609 | B2 | 2/2013 | Yokota | |
| 8,435,137 | B2 * | 5/2013 | Hirano | A63B 53/0466 473/345 |
| 8,439,769 | B2 * | 5/2013 | Rice | A63B 53/0466 473/329 |
| 8,550,935 | B2 | 10/2013 | Stites | |
| 8,727,908 | B2 | 5/2014 | Goto | |
| 8,932,150 | B2 * | 1/2015 | Ines | A63B 53/047 473/342 |
| 9,101,809 | B2 | 8/2015 | Gibbs | |
| 9,162,115 | B1 | 10/2015 | Beach | |
| 9,192,828 | B2 | 11/2015 | Curtis | |
| 9,220,954 | B2 | 12/2015 | Matsunaga | |
| 9,433,835 | B2 | 9/2016 | Sugimae | |
| 9,623,292 | B2 | 4/2017 | Abe | |
| 9,669,270 | B2 | 6/2017 | Schweigert | |
| 9,675,849 | B2 | 6/2017 | Beach | |
| 2003/0181257 | A1 * | 9/2003 | Yamamoto | A63B 53/04 473/342 |
| 2006/0052179 | A1 | 3/2006 | Hou | |
| 2006/0128501 | A1 | 6/2006 | Rice | |
| 2011/0159987 | A1 | 6/2011 | Takechi | |
| 2015/0119166 | A1 | 4/2015 | Deshmukh | |
| 2015/0328506 | A1 | 11/2015 | Morales | |
| 2018/0001160 | A1 | 1/2018 | Abe | |
| 2018/0318667 | A1 * | 11/2018 | Wester | A63B 53/0466 |

FOREIGN PATENT DOCUMENTS

| | | | | |
|---|---|---|---|---|
| JP | 3352315 | | 9/2002 | |
| JP | 2002315854 | | 10/2002 | |
| JP | 2003117032 | A * | 4/2003 | A63B 3/047 |
| JP | 4719113 | | 4/2011 | |
| JP | 5698168 | | 2/2015 | |
| JP | 5795919 | | 8/2015 | |
| JP | 5998092 | | 9/2016 | |

* cited by examiner

GOLF CLUB HEAD WITH VARIABLE FACE THICKNESS

CROSS REFERENCE TO RELATED APPLICATIONS

This claims the benefit of U.S. Provisional Application No. 62/757,925, filed Nov. 9, 2018, and also claims the benefit of U.S. Provisional Application No. 62/610,074, filed Dec. 22, 2017, the contents of all of which are incorporated fully herein by reference.

FIELD OF THE INVENTION

The present disclosure relates to hollow body golf club heads, more specifically, a club head having a variable face thickness to improve ball speed while maintaining characteristic time (CT) requirements and face durability.

BACKGROUND

Golf club design takes into account several performance characteristics, such as ball speed. Typically, golf club designs aim to increase ball speed by increasing the characteristic time (CT) of the face. However, current designs are limited due to durability considerations. Therefore, there is a need in the art for a club head that further increases or maximizes CT while maintaining or improving the durability of the face.

Figure 1:
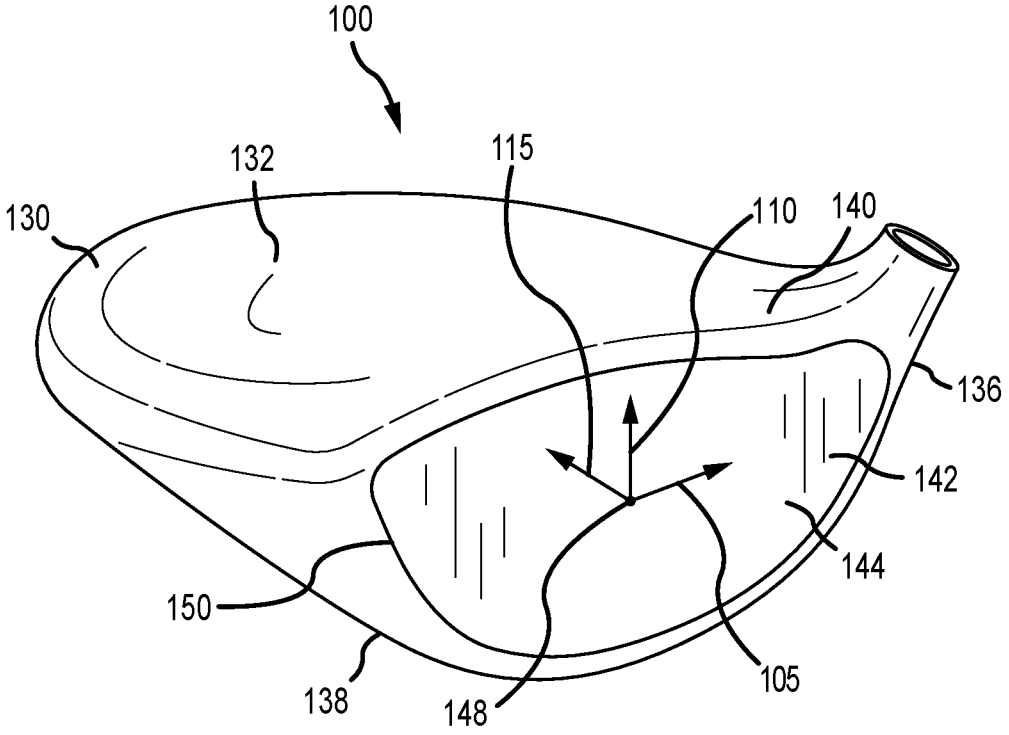
FIG. 1 illustrates a front perspective view of a golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf club heads with weights. The same reference numerals in different figures denote the same elements.

DETAILED DESCRIPTION

Described herein is a hollow body golf club head comprising a varying face thickness to provide (1) a maximum characteristic time (CT) within the United States Golf Association (USGA) requirements, (2) an increase in ball speed and launch angle of a golf ball during impact, and (3) an increase in the durability in the face. To achieve these advantages, the face of the hollow body club head includes strategically positioned thickened and thinned regions. More specifically, the face includes a perimeter thickened region positioned near a perimeter of the face, a thinned region positioned inward of the perimeter thickened region toward a center of the face, and a central thickened region positioned over the center of the face. The perimeter thickened region increases the durability in the face. In some embodiments, the perimeter thickened region further includes a weld line that couples the face to the hollow body, where the thickness of the face is constant on both sides of the weld line to improve the durability of the region around the weld line. The thinned region of the face comprising the minimum thickness of the face increases ball speed for off center hits and further increases or maximizes the CT of the face. The central thickened region increases the ball speed for center hits and further increases or maximizes the CT of the face. The combination of the perimeter thickened region, the central thickened region, and the thinned region provides the hollow body golf club head with increased or maximized CT, and increased ball speed while maintaining durability in the face over many golf ball impacts.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

As defined here, "spline method" refers to a method to determine the location where the curvature of a surface changes. For example, the spline method can be used to determine where the curvature deviates from the bulge and roll of the striking surface of a golf club head. The bulge is the curvature of the striking surface in a heel to toe direction. The roll is the curvature of the striking surface in a crown to sole direction. The spline method can be implemented by imposing a spline onto the curved surface with an interval such that the spline indicates where a significant change in curvature begins.

The terms "loft" or "loft angle" of a golf club, as described herein, refers to the angle formed between the club face and the shaft, as measured by any suitable loft and lie machine.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Embodiments of a golf club head are described herein, wherein the golf club head can comprise a driver-type club head, a fairway wood-type club head, or a hybrid-type club head. For example, in some embodiments, the golf club head can comprise a driver-type club head. The driver-type club head comprises a loft angle and a volume. In many embodiments, the loft angle of the driver-type club head is less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, the volume of the driver-type club head is greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver-type club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

For further example, in some embodiments, the golf club head can comprise a fairway wood-type club head. The fairway wood-type club head comprises a loft angle and a volume. In many embodiments, the loft angle of the fairway wood-type club head is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the fairway wood-type club head is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway wood-type club head can be between 12 degrees and 35 degrees, between 15 degrees and 35 degrees, between 20 degrees and 35 degrees, or between 12 degrees and 30 degrees.

Further, in many embodiments, the volume of the fairway wood-type club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood-type club head can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

Further, in many embodiments, the fairway wood-type club head comprises a striking surface height. The striking surface height is measured through a geometric center of the striking surface from a sole perimeter edge (i.e. sole outer edge) of the striking surface to a crown perimeter edge (i.e. crown outer edge) of the striking surface in a direction parallel to a loft plane. The outer edge and the loft plane are described in more detail below. In many embodiments, the striking surface height can range from 0.5 to 2.0 inch. In some embodiments, the striking surface height can range from 0.5 to 1.0 inch, or 1.0 to 2.0 inch. In other embodiments, the striking surface height can range from 0.6 to 1.10 inch, 0.7 to 1.20 inch, 0.8 to 1.30 inch, 0.9 to 1.40 inch, 1.0 to 1.50 inch, 1.10 to 1.60 inch, 1.20 to 1.70 inch, 1.30 to 1.80 inch, 1.40 to 1.90 inch, or 1.50 to 2.0 inch. In other examples still, the striking surface height can be 0.5, 0.6, 0.7, 0.8, 0.85, 0.90, 0.95, 1.0, 1.05, 1.10, 1.15, 1.20, 1.25, 1.30, 1.40, 1.50, 1.60, 1.70, 1.80, 1.90, or 2.0 inch. In one example, the striking surface height can range from 1.0 to 1.15 inch.

For further example, in some embodiments, the golf club head can comprise a hybrid-type club head. The hybrid-type club head comprises a loft angle and a volume. In many embodiments, the loft angle of the hybrid-type club head is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid-type club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, in many embodiments, the volume of the hybrid-type club head is less than approximately 200 cc, less than approximately 175 cc, less than approximately 150 cc, less than approximately 125 cc, less than approximately 100 cc, or less than approximately 75 cc. In some embodiments, the volume of the hybrid-type club head can be approximately 100 cc-150 cc, approximately 75 cc-150 cc, approximately 100 cc-125 cc, or approximately 75 cc-125 cc.

The golf club head can be formed from a metal, a metal alloy, or a composite. The golf club head can be formed from steel, steel alloys, stainless steel, stainless steel alloys, nickel, nickel alloys, cobalt, cobalt alloys, titanium, titanium alloys, an amorphous metal alloy, or other similar materials. For example, the golf club head can be formed from C300 steel, C350 steel, 17-4 stainless steel, or T9s+ titanium.

General Description of an Embodiment of a Golf Club Head

FIGS. 1-6 illustrate an embodiment of a club head 100. The club head 100 comprises a front body portion 140 and a rear body portion 130. The front body portion 140 and the rear body portion 130 form an enclosed hollow interior cavity. The club head 100 further includes a crown 132, a sole 134 opposite the crown 132, a heel 136, and a toe 138 opposite the heel 136.

The front body portion 140 generally includes a face 142 having a striking surface 144 intended to impact a golf ball, a back surface 146 opposite the striking surface 144, a geometric center 148, and an outer edge 150. The back surface 146 of the face 142 is located in the enclosed hollow interior cavity of the club head 100. The geometric center 148 of the face 142 can be located at a geometric midpoint of the face 142. In one approach, the geometric center 148 can be located in accordance with the definition of a golf governing body such as the United States Golf Association (USGA). For example, the geometric center 148 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibiltiy-Of-A-Golf-Club-Head/) (the "Flexibility Procedure").

Figure 2:
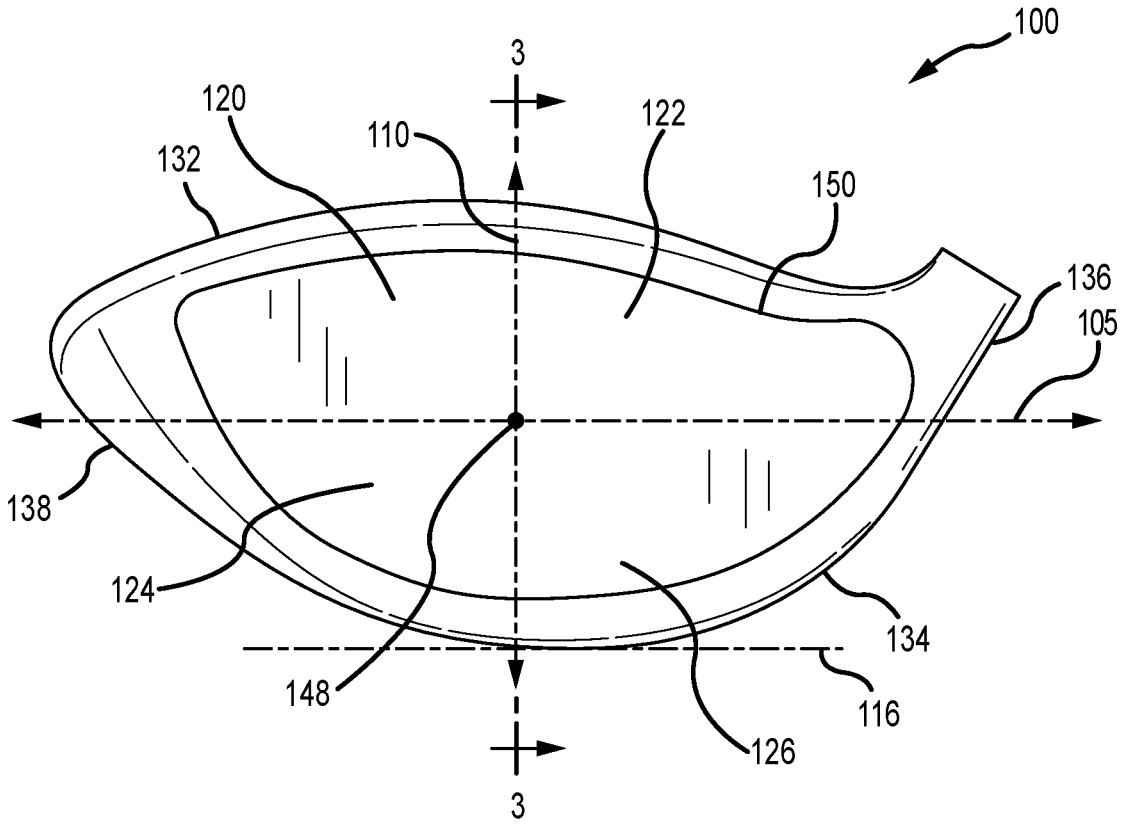
FIG. 2 illustrates a front view of the golf club head of FIG. 1.

Further referring to FIGS. 1 and 2, the geometric center 148 of the face 142 defines an origin of a coordinate system having an x-axis 105, a y-axis 110, and a z-axis 115. The x-axis 105 extends through the geometric center 148 from near the heel 136 to near the toe 138 of the club head 100 in a direction parallel to a ground plane 116. The y-axis 110 extends through the geometric center 148 from near the crown 132 to near the sole 134 of the club head 100 in a direction perpendicular to the ground plane 116. The z-axis 115 extends through the geometric center 148 from the front body portion 140 to the rear body portion 130 of the club head 100 in a direction parallel to the ground plane 116.

Figure 3:
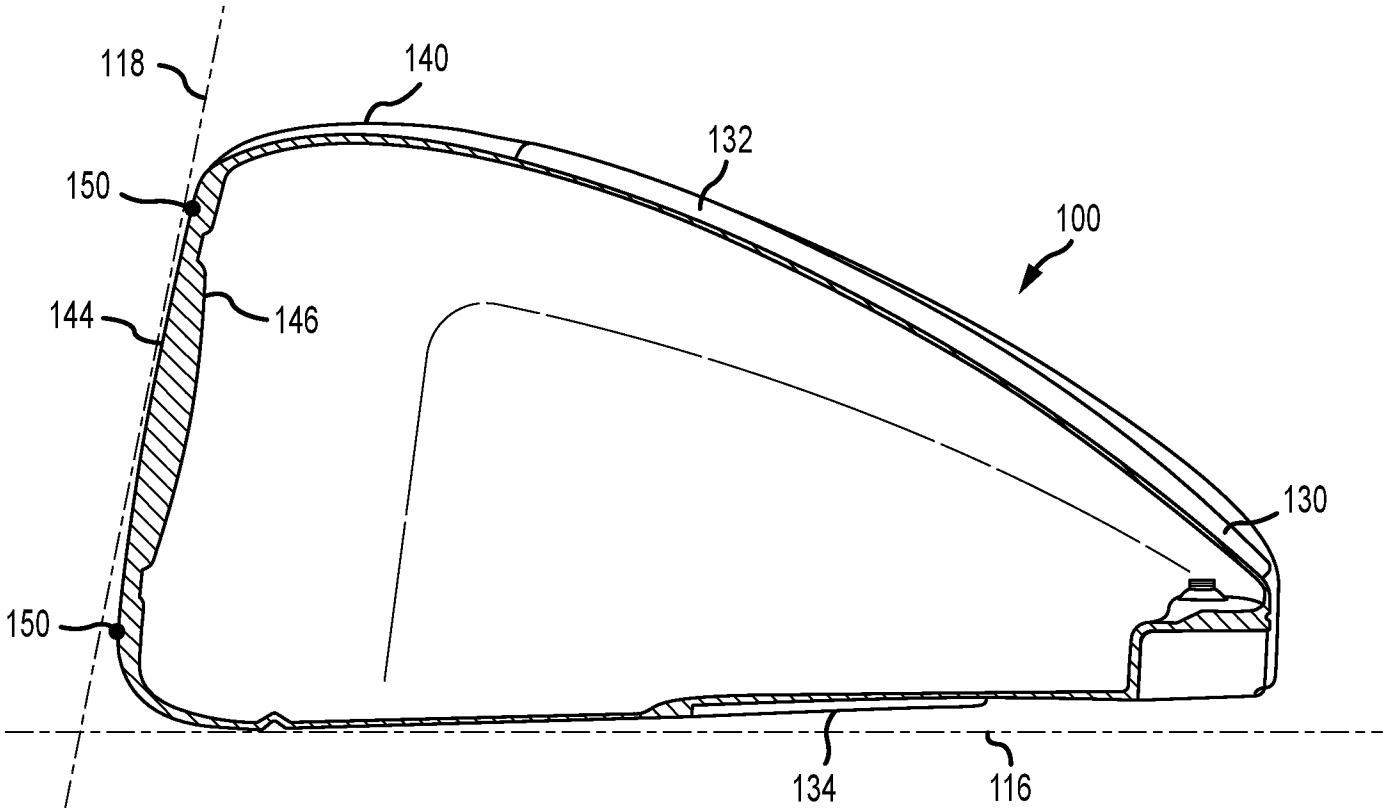
FIG. 3 illustrates a cross sectional view of the golf club head of FIG. 1 taken at line 3-3 of FIG. 2.

As illustrated in FIG. 3, the club head 100 comprises a loft plane 118 that is tangent to the striking surface 144 and extends through the geometric center 148 of the face 142. The loft plane 118 is positioned at an acute angle with respect to the y-axis 110, wherein the acute angle can correspond to the loft angle of the club head 100.

As illustrated in FIG. 2, the x-axis 105 and the y-axis 110 divide the face 142 of the club head 100 into four quadrants including a high toe quadrant 120 located near the toe 138 and crown 132, a low toe quadrant 124 located near the toe 138 and the sole 134, a high heel quadrant 122 located near the heel 136 and the crown 132, and a low heel quadrant 126 located near the heel 136 and the sole 134.

The outer edge 150 of the face 142 extends along a perimeter of the striking surface 144 and can be defined where the curvature deviates from the bulge and roll of the striking surface 144. More specifically, the outer edge 150 can extend entirely along a perimeter of the striking surface 144 near the crown 132, the toe 138, the sole 134, and the heel 136 where the curvature deviates from the bulge and roll of the striking surface 144. In one approach, the spline method, as described above, can be used to determine the location of the outer edge 150 where the curvature deviates from the bulge and roll of the striking surface 144.

Face of the Golf Club Head

As described above, referring to FIGS. 4-6, the club head 100 includes the front body portion 140 having the face 142. The face 142 comprises a thickness measured from the striking surface 144 to the back surface 146 in a direction perpendicular to the loft plane 118. The thickness of the face 142 varies and is described below with reference to one or more regions 160 extending radially from the geometric center 148 to the outer edge 150 of the striking surface 144 (i.e. in a direction of a radius, extending in a direction from the geometric center 148 of the face 142 outward towards the outer edge 150 of the striking surface 144, or extending in a direction from the outer edge 150 inward towards the geometric center 148).

Figure 4:
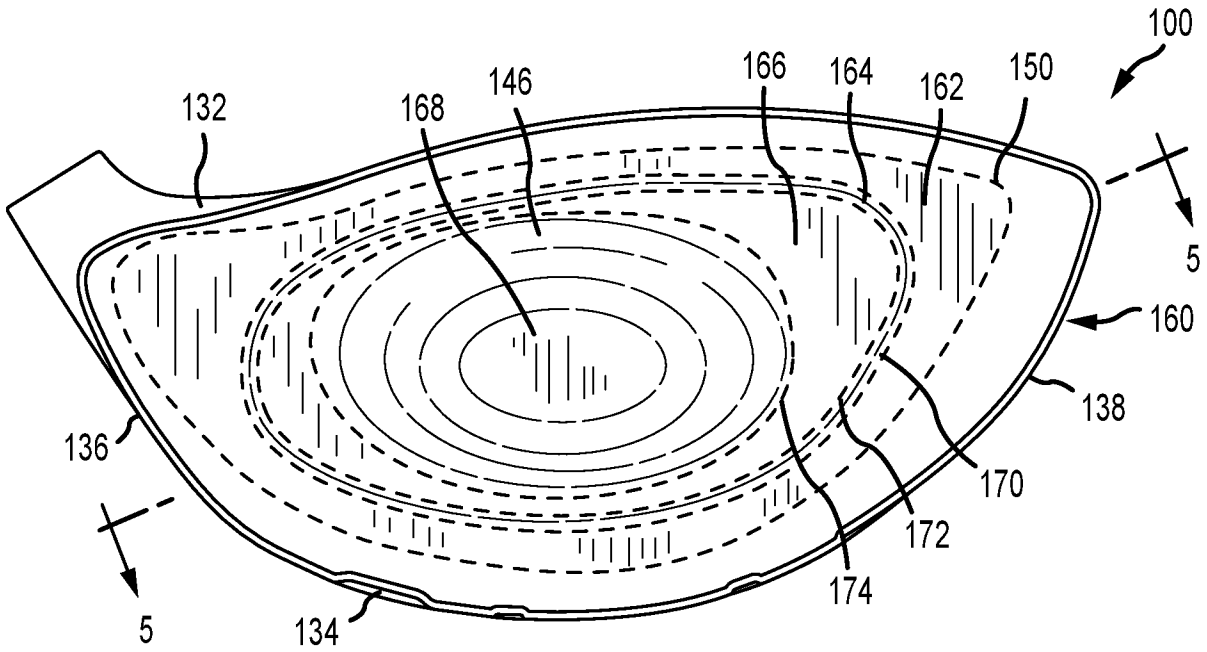
FIG. 4 illustrates a partial cut-away rear perspective view of the golf club head of FIG. 1.
Figure 5:
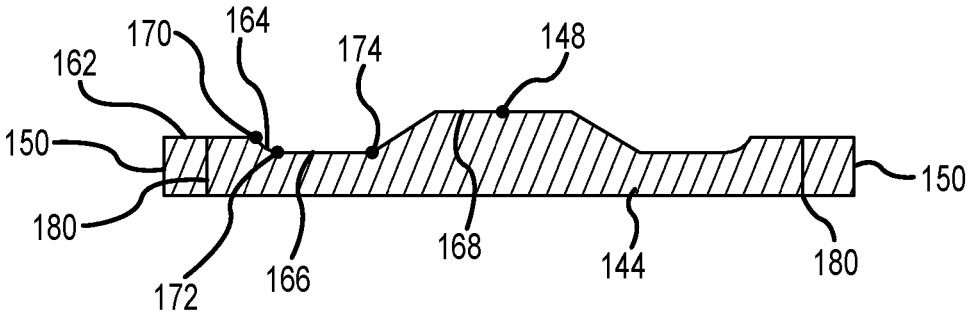
FIG. 5 illustrates a cross sectional view of the golf club head of FIG. 1 taken at line 5-5 of FIG. 4.
Figure 6:
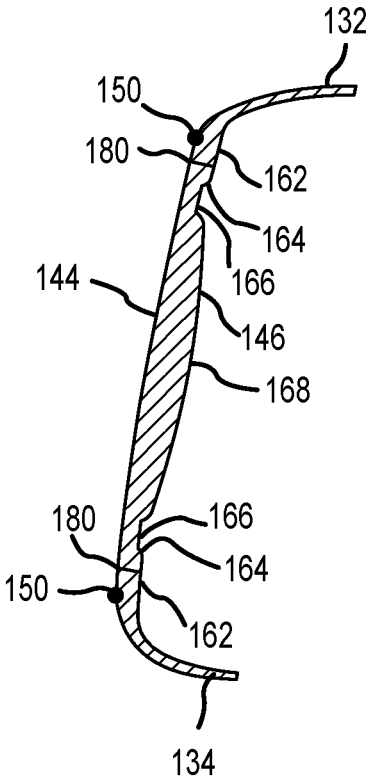
FIG. 6 illustrates an enlarged, cross sectional view of the golf club head of FIG. 1 taken at line 3-3 of FIG. 2.

As illustrated in FIGS. 4-6, the one or more regions 160 include a perimeter region 162, a transition region 164, an intermediate region 166, and a central region 168. The perimeter region 162 abuts or contacts the outer edge 150 of the striking surface 144 and extends inward toward the geometric center 148 of the face 142 from the outer edge 150. The perimeter region 162 comprises a perimeter thickness that is constant and defines the boundary of the perimeter region 162.

The transition region 164 abuts or contacts the perimeter region 162 and extends inward toward the geometric center 148 of the face 142 from the perimeter region 162. The transition region 164 comprises a transition thickness that varies in a direction from the perimeter region 162 toward the geometric center 148 of the face 142. In many embodiments, the transition thickness decreases in a direction from the perimeter region 162 toward the geometric center 148 of the face 142.

The intermediate region 166 abuts or contacts the transition region 164 and extends inward toward the geometric center 148 of the face 142 from the transition region 162. The intermediate region 166 comprises a intermediate thickness that is constant and defines the boundary of the intermediate region 166. The intermediate thickness is less than the perimeter thickness. In many embodiments, the intermediate thickness comprises the minimum thickness of the face 142.

The central region 168 abuts or contacts the intermediate region 166 and extends inward toward the geometric center 148 of the face 142 from the intermediate region 166. The central region 168 can encompass the geometric center 148 of the face 142. The central region 168 comprises a central thickness that can vary and/or remain constant. In many embodiments, the central thickness comprises the maximum thickness of the face 142. In many embodiments, the central thickness comprises a varying thickness that increases in a direction from the intermediate region 166 toward the geometric center 148 and a constant thickness positioned over the geometric center of the face 142.

The one or more regions 160 of the face 142 are further separated or bounded by one or more boundary lines that extend around each region. The one or more boundary lines separate and further define the boundaries of the one or more regions 160. As illustrated in FIGS. 4 and 5, the one or more boundary lines include a perimeter boundary 170, a transition boundary 172, and an intermediate boundary 174. The perimeter boundary 170 defines the boundary between the perimeter region 162 and the transition region 164, the transition boundary 172 defines the boundary between the transition region 164 and the intermediate region 166, and the intermediate boundary 174 defines the boundary between the intermediate region 166 and the central region 168. For example, the perimeter boundary 170 defines the locations on the face 142 where the perimeter region 162 transitions to the transition region 164. In another example, the transition boundary 172 defines the locations on the face 142 where the transition region 164 transitions to the intermediate region 166. In another example, the intermediate boundary 174 defines the location on the face 142 where the intermediate region 166 transitions to the central region 168. The locations of the one or more boundary lines relative to each other and relative to the one or more regions 160 are described in more detail below.

As illustrated in FIGS. 4 and 5, the perimeter region 162 extends inward from the outer edge 150 of the striking surface 144 towards the perimeter boundary 170. The perimeter boundary 170 defines the locations on the face 142 where the thickness of the face 142 deviates from the constant perimeter thickness. The constant perimeter thickness extends from the outer edge 150 to the perimeter boundary 170. The transition region 164 extends inward from the perimeter boundary 170 towards the transition boundary 172. The transition boundary 172 defines the locations on the face 142 where the thickness of the face 142 deviates from the varying transition thickness. The varying transition thickness extends from the perimeter boundary 170 to the transition boundary 172.

The intermediate region 166 extends inward from the transition boundary 172 toward the intermediate boundary 174. The intermediate boundary 174 defines the locations on the face 142 where the thickness of the face 142 deviates from the constant intermediate thickness. The constant intermediate thickness extends from the transition boundary 172 to the intermediate boundary 174. The central region 168 extends inward from the intermediate boundary 174 towards the geometric center 148 of the face 142. The central thickness comprises a varying thickness and a constant thickness from the intermediate boundary 174 to the geometric center 148 of the face 142.

The combination of the thickened central thickness, the thinned intermediate thickness, and the thickened perimeter thickness results in golf ball speed gains while increasing the durability in the face 142. Specifically, the thickened central thickness increases ball speed and further increases or maximizes the CT of the face 142. The thickened constant perimeter thickness increases the structural rigidity at the outer edge 150 of the striking surface 144, thereby improving the durability in the face 142. Further, the thinned constant intermediate thickness increases ball speed for off center hits and further increases or maximizes the CT of the face 142 without sacrificing durability. The combination of the thickened central thickness, the thinned intermediate thickness, and the thickened perimeter thickness of the club head 100 can result in 0.5 to 2.0 mph greater ball speed, and 1% to 5% greater CT compared to a club head devoid of the described thickened and thinned regions.

Perimeter Region

As illustrated in FIGS. 4-6, the thickness of the face 142 varies and is described with reference to one or more regions 160. The one or more regions 160 of the face 142 comprises the perimeter region 162. The perimeter region 162 extends inward toward the geometric center 148 from the outer edge 150 of the striking surface 144. The perimeter region 162 comprises a perimeter thickness that is constant and defines the boundary of the perimeter region 162. More specifically, the perimeter region 162 extends inward from the outer edge 150 towards the perimeter boundary 170. The perimeter boundary 170 defines the locations on the face 142 where the thickness of the face 142 deviates from the constant perimeter thickness. The constant perimeter thickness extends from the outer edge 150 to the perimeter boundary 170. The perimeter thickness is greater than the intermediate thickness, but less than the central thickness.

In many embodiments, the perimeter thickness for driver-type club heads can be greater than or equal to 0.06 inch, greater than or equal to 0.07 inch, greater than or equal to 0.08 inch, greater than or equal to 0.085 inch, greater than or equal to 0.09 inch, greater than or equal to 0.095 inch, or greater than or equal to 0.10 inch. In other embodiments, the perimeter thickness for driver-type club heads can range from 0.06 to 0.16 inch. In some embodiments, the perimeter thickness for driver-type club head can range from 0.06 to 0.11 inch, or 0.11 to 0.16 inch. In some embodiments, the perimeter thickness for driver-type club heads can range from 0.06 to 0.08 inch, 0.08 to 0.10 inch, 0.10 to 0.12 inch, 0.12 to 0.14 inch, or 0.14 to 0.16 inch. For example, the perimeter thickness for driver-type club heads can be approximately 0.06, 0.065, 0.07, 0.075, 0.08, 0.085, 0.09, 0.092, 0.095, 0.10, 0.105, 0.11, 0.115, 0.12, 0.125, 0.13, 0.135, 0.14, 0.145, 0.15, 0.155, 0.16, 0.165, 0.17, 0.175, or 0.18 inch. In another example, the perimeter thickness for driver-type club heads can be 0.092 inch. In another example, the perimeter thickness for driver-type club heads can be 0.10 inch.

In many embodiments, the perimeter thickness for fairway wood-type club heads can be greater than or equal to 0.05 inch, greater than or equal to 0.06 inch, greater than or equal to 0.065 inch, greater than or equal to 0.07 inch, greater than or equal to 0.08 inch, greater than or equal to 0.09 inch, or greater than or equal to 0.10 inch. In other embodiments, the perimeter thickness for fairway wood-type club heads can range from 0.05 to 0.10 inch. In some embodiments, the perimeter thickness for fairway wood-type club heads can range from 0.05 to 0.075 inch, or 0.075 to 0.10 inch. In some embodiments, the perimeter thickness for fairway wood-type club heads can range from 0.05 to 0.06 inch, 0.06 to 0.07 inch, 0.07 to 0.08 inch, 0.08 to 0.09 inch, or 0.09 to 0.10 inch. For example, the perimeter thickness for fairway wood-type club heads can be approximately 0.05, 0.055, 0.06, 0.065, 0.07, 0.075, 0.08, 0.085, 0.09, 0.095, or 0.10 inch. In another example, the perimeter thickness for fairway wood-type club heads can be 0.07 inch.

Figure 7:
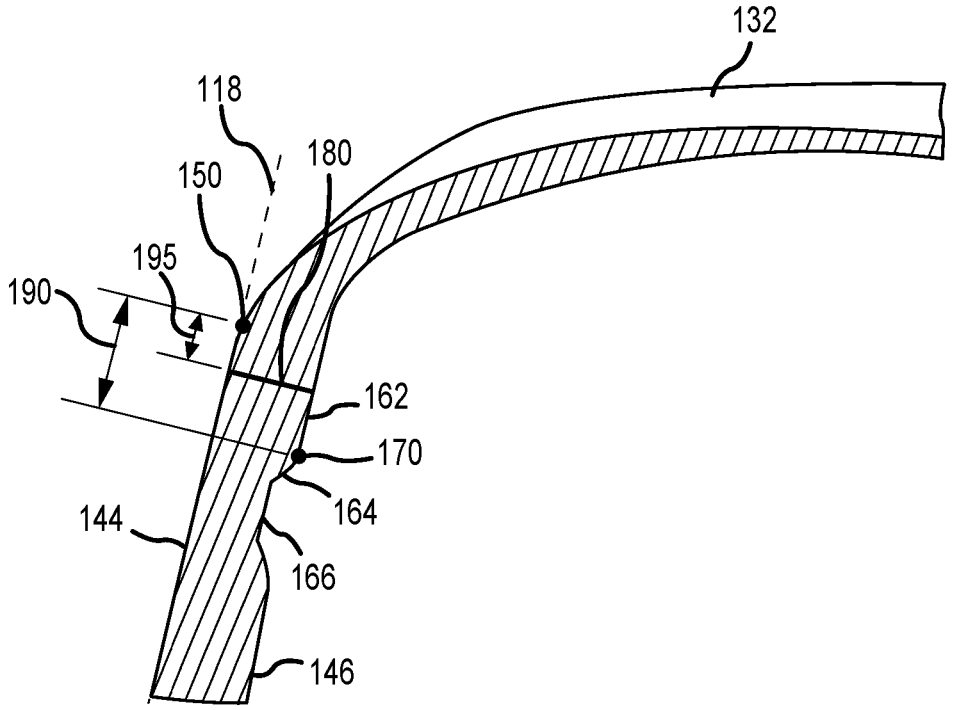
FIG. 7 illustrates an enlarged, cross sectional view of the golf club head of FIG. 1 taken at line 3-3 of FIG. 2.

As illustrated in FIG. 7, the perimeter region 162 can extend inward from the outer edge 150 of the face 142 by a perimeter distance 190. The perimeter distance 190 can be measured from outer edge 150 of the striking surface 144 to the perimeter boundary 170 in a direction parallel to the loft plane 118. In many embodiments, the perimeter distance 190 can be less than or equal to 0.25 inch, less than or equal to 0.20 inch, less than or equal to 0.15 inch, or less than or equal to 0.10 inch. In other embodiments, the perimeter distance 190 can range from 0 to 0.25 inch. In some embodiments, the perimeter distance 190 can range from 0 to 0.15 inch, or 0.15 to 0.25 inch. In some embodiments, the perimeter distance 190 can range from 0 to 0.10 inch, 0.10 to 0.15 inch, 0.15 to 0.20 inch, or 0.20 to 0.25 inch. In other examples still, the perimeter distance 190 can be approximately 0, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, or 0.25 inch. For example, the perimeter distance 190 can be 0.09 inch for driver-type club heads. In another example, the perimeter distance 190 can be 0.141 inch for fairway wood-type club heads.

Figure 8:
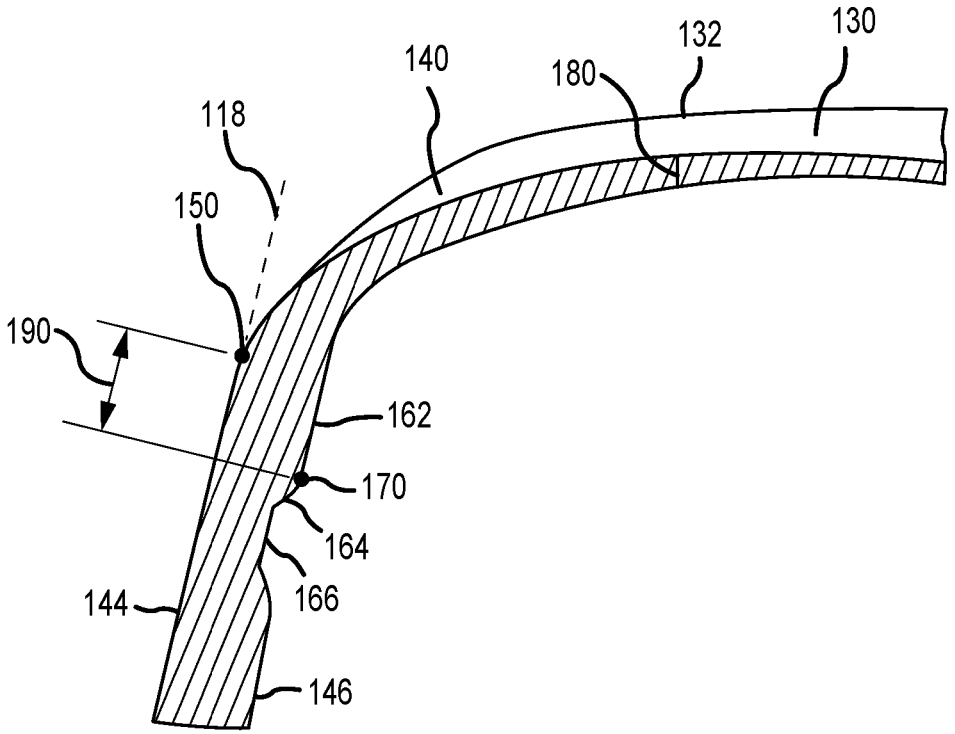
FIG. 8 illustrates an enlarged, cross sectional view of a golf club head according to another embodiment.

As illustrated in FIGS. 5-7, the perimeter region 162 can further comprise a junction between the front body portion 140 and the rear body portion 130. The junction between the front body portion 140 and the rear body portion 130 can comprise a weld line 180, where the front body portion 140 is welded onto the rear body portion 130. In many embodiments, the weld line 180 can extend from the striking surface 144 to the back surface 146 of the face 142 in a direction perpendicular to the loft plane 118. In an alternative embodiment, as illustrated in FIG. 8, the perimeter region 162 may not comprise the weld line 180. In this alternative embodiment, the junction between the front body portion 140 and the rear body portion 130 can be located on the crown 132 and/or sole 134 of the club head 100 offset from the striking surface 144. In this alternative embodiment, where the junction between the front body portion 140 and the rear body portion 130 is offset from the striking surface 144, the club head 100 can comprise a cup-shaped appearance.

As illustrated in FIG. 7, the weld line 180 can be positioned inward from the outer edge 150 of the striking surface 144 by a weld or junction distance 195 (hereafter "weld distance"). The weld distance 195 can be measured from the outer edge of the striking surface 144 to the weld line 180 in a direction parallel to the loft plane 118. The weld distance 195 is less than the perimeter distance 190 such that the thickness of the face 142 is constant on both sides of the weld line 180. The consistent thickness of the face 142 on both sides of the weld line 180 can provide the club head 100 15% to 30% increase in durability compared to a club head devoid of thickened constant perimeter thickness and the consistent face thickness on both sides of the weld line 180.

In many embodiments, the weld distance 195 can be less than or equal 0.20 inch, less than or equal to 0.15 inch, or less than or equal to 0.10 inch. In other embodiments, the weld distance 195 can range from 0.05 to 0.2 inch. In some embodiments, the weld distance 195 can range from 0 to 0.15 inch, or 0.10 to 0.20 inch. In some embodiments, the weld distance 195 can range from 0 to 0.10 inch, 0.10 to 0.15 inch, or 0.15 to 0.20 inch. In other examples still, the weld distance 195 can be approximately 0, 0.05, 0.06, 0.07, 0.08, 0.09, 0.10, 0.11, 0.12, 0.13, 0.14, 0.15, 0.16, 0.17, 0.18, 0.19, or 0.20 inch. In another example, the weld distance 195 can be 0.065 inch for driver-type club heads. In another example, the weld distance 195 can be 0.098 inch for fairway wood-type club heads.

Figure 9:
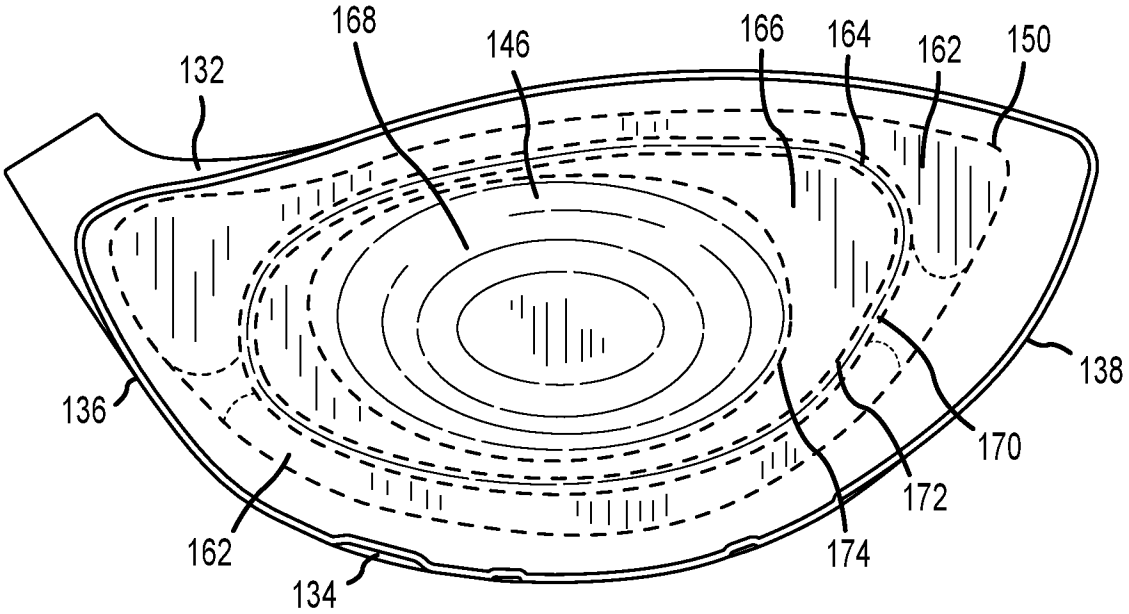
FIG. 9 illustrates a partial cut-away rear perspective view of a golf club head according to another embodiment.
Figure 10:
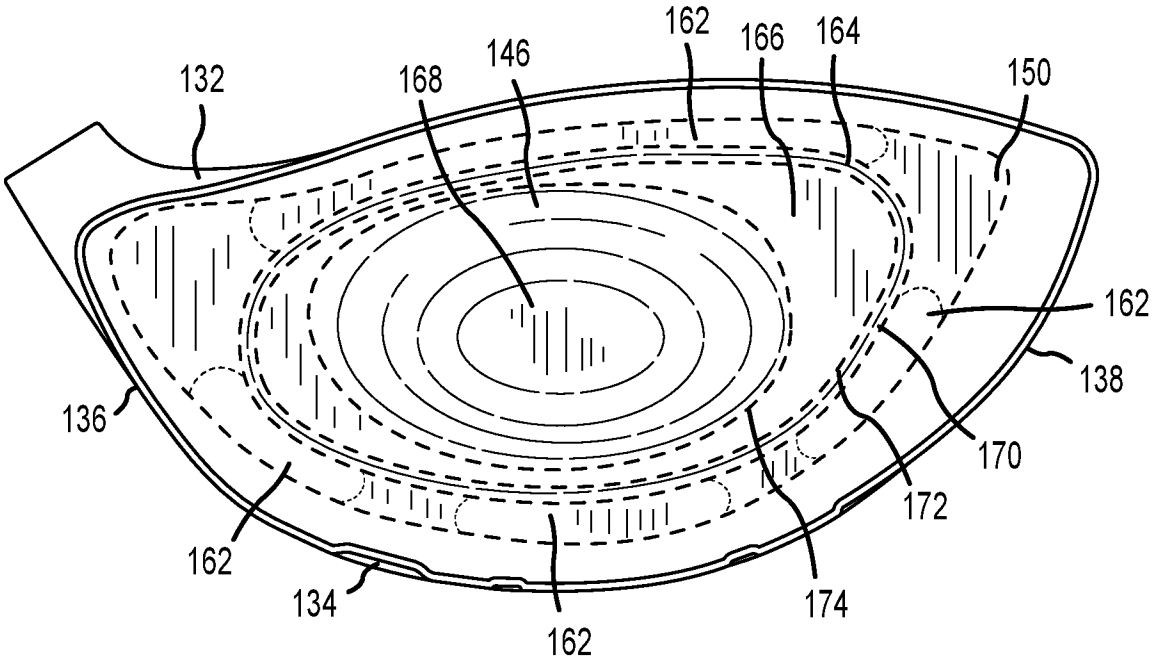
FIG. 10 illustrates a partial cut-away rear perspective view of a golf club head according to another embodiment.

In many embodiments, the constant perimeter thickness can extend continuously around the entire perimeter or circumference of the striking surface 144. In other embodiments, the perimeter region 162 can extend discontinuously around the perimeter of the face 142. In these embodiments, as illustrated in FIGS. 9 and 10, the perimeter region 162 can comprise one or more perimeter region zones 162 comprising the constant perimeter thickness. For example, the one or more perimeter region zones 162 can comprise one, two, three, four, five, six, seven, eight, nine, or ten perimeter region zones 162. In these embodiments, the perimeter region 162 may not extend 100% around the perimeter of the striking surface 144. In these embodiments, the perimeter region 162 can extend greater than 60%, greater than 65%, greater than 70%, greater than 75%, greater than 80%, greater than 85%, greater than 90%, or greater than 95% around the perimeter of the striking surface 144. In other embodiments, the perimeter region 162 can extend 60% to 80%, or 80% to 100% around the perimeter of the striking surface 144. In other examples still, the perimeter region 162 can extend 60% to 100%, 70% to 100%, or 80% to 100% around the perimeter of the striking surface 144. In other examples still, the perimeter region 162 can extend 60% to 90%, 70% to 90%, or 80% to 90%.

In some embodiments, the thickness of the face 142 between the outer edge 150 and the perimeter boundary 170, and outside the one the or more perimeter region zones 162 can be less than or equal to the constant perimeter thickness of the one or more perimeter region zones 162. In other embodiments, the thickness of the face 142 between the outer edge 150 and the perimeter boundary 170, and outside the one or more perimeter region zones 162 can be greater than or equal to the constant perimeter thickness of the one or more perimeter region zones 162. The one or more perimeter region zones 162 allow for weight to be removed from the face 142 and to be positioned in other portions of the club head 100 such as the sole 134 to adjust center of gravity location and improve moment of inertia.

In one example, as illustrated in FIG. 9, the perimeter region 162 can be separated into two perimeter region zones 162 comprising the constant perimeter thickness. The perimeter region zones 162 can be positioned near the crown 132 and/or the sole 134 of the club head 100. More specifically, a first perimeter region zone 162 can extend within the high toe quadrant 120 and the high heel quadrant 122, and a second perimeter region zone 162 can extend within the low toe quadrant 124 and the low heel quadrant 126. In this embodiment, the two perimeter region zones 162 can extend greater than 90% around the perimeter of the striking surface 144. Further, in this embodiment, the thickness of the face 142 between the outer edge 150 and the perimeter boundary 170, and outside the two perimeter region zones 162 can be less than or equal to the constant perimeter thickness of the two perimeter region zones 162.

In another example, as illustrated in FIG. 10, the perimeter region 162 can be separated into four perimeter region zones 162 comprising the constant perimeter thickness. The perimeter region zones 162 can be positioned near the crown 132, the sole 134, the heel 136, and/or the toe 138 of the club head 100. More specifically, a first perimeter region zone 162 can extend within the high toe quadrant 120 and the high heel quadrant 122, a second perimeter region zone 162 can extend within the high heel quadrant 122 and the low heel quadrant 126, a third perimeter region zone 162 can extend within the low heel quadrant 126 and the low toe quadrant 124, and a fourth perimeter region zone 162 can extend within the low toe quadrant 124 and the high toe quadrant 126. In this embodiment, the four perimeter region zones 162 can extend greater than 75% around the perimeter of the striking surface 144. Further, in this embodiment, the thickness of the face 142 between the outer edge 150 and the perimeter boundary 170, and outside the four perimeter zones 162 can be less than or equal to the constant perimeter thickness of the four perimeter region zones 162.

Transition Region

As illustrated in FIGS. 4-6, the thickness of the face 142 varies and is described with reference to one or more regions 160. The one or more regions 160 of the face 142 comprises the transition region 164. The transition region 164 extends inward toward the geometric center 148 of the face 142 from the perimeter region 162. The transition region 164 comprises a transition thickness that varies in a direction from the perimeter region 162 inward toward the geometric center of the face 142. More specifically, the transition region 164 extends inward from the perimeter boundary 170 to the transition boundary 172. The transition boundary 170 defines the locations on the face 142 where the thickness of the face 142 deviates from the varying transition thickness. The transition thickness varies from the perimeter boundary 170 to the transition boundary 172. In many embodiments, the transition thickness decreases in a direction from the perimeter region 162 inward toward the geometric center 148 of the face 142.

The transition thickness can change greatly over a small distance. The transition thickness can be defined by one or more radii. In one example, the transition region 164 comprises two radii, where a first radius is convex relative to the striking surface 144, and a second radius is concave relative to the striking surface 144. An inflection point is positioned between the first and second radius, where the inflection point defines the location of the change in curvature of the transition thickness (i.e. from a convex to concave curvature). Smaller radii result in a greater rate of change of the transition thickness. Larger radii result in a small rate of change of the transition thickness. In many embodiments, the radii of the transition thickness can range from 0.05 to 0.5 inch. In some embodiments, the radii of the transition thickness can range from 0.05 to 0.25 inch, or 0.25 to 0.5 inch. In some embodiments, the radii of the transition thickness can range from 0.05 to 0.125 inch, 0.125 to 0.25, 0.25 to 0.375 inch, or 0.375 to 0.5 inch. For example, the radii of the transition thickness can be 0.05, 0.1, 0.15, 0.20, 0.25, 0.30, 0.35, 0.40, 0.45, or 0.50 inch. In another example, the radii of the transition thickness for driver-type club heads can be 0.10 inch. In another example, the radii of the transition thickness for fairway wood-type club heads can be 0.40 inch.

Intermediate Region

As illustrated in FIGS. 4-6, the thickness of the face 142 varies and is described with reference to one or more regions 160. The one or more regions 160 of the face 142 comprises the intermediate region 166. The intermediate region 166 extends inward towards the geometric center 148 of the face 142 from the transition region 164. The intermediate region 166 comprises a intermediate thickness that is constant and defines the boundary of the intermediate region 164. More specifically, the intermediate region 166 extends inward from the transition boundary 172 to the intermediate boundary 174. The intermediate boundary 174 defines the locations on the face 142 where the thickness of the face 142 deviates from the constant intermediate thickness. The constant intermediate thickness extends from transition boundary 172 to the intermediate boundary 174.

In many embodiments, the intermediate thickness comprises the minimum thickness of the face 142. The intermediate thickness is less than the perimeter thickness. The constant intermediate thickness can extend continuously around the striking surface 144. The intermediate region 166 can comprise no steps in thickness.

In many embodiments, the intermediate thickness for driver-type club heads can be less than or equal to 0.10 inch, less than or equal to 0.09 inch, less than or equal to 0.08 inch, less than or equal to 0.085 inch, less than or equal to 0.07 inch, or less than or equal to 0.06 inch. In other embodiments, the intermediate thickness for driver-type club heads can range from 0.05 to 0.10. In some embodiments, the intermediate thickness for driver-type club heads can range from 0.05 to 0.075, or 0.075 to 0.10 inch. In some embodiments, the intermediate thickness for driver-type club heads can range from 0.05 to 0.06 inch, 0.06 to 0.07 inch, 0.07 to 0.08 inch, 0.08 to 0.09 inch, or 0.09 to 0.10 inch. For example, the intermediate thickness for driver-type club heads can be approximately 0.05, 0.055, 0.06, 0.065, 0.07, 0.075, 0.08, 0.082, 0.085, 0.09 inch, or 0.10 inch. In another example, the intermediate thickness for driver-type club heads can be 0.082 inch.

In many embodiments, the intermediate thickness for fairway wood-type club heads can be less than or equal to 0.09 inch, less than or equal to 0.08 inch, less than or equal to 0.07 inch, less than or equal to 0.065 inch, less than or equal to 0.06 inch, or less than or equal to 0.05 inch. In other embodiments, the intermediate thickness for fairway wood-type club heads can range from 0.04 to 0.08 inch. In some embodiments, the intermediate thickness for fairway wood-type club heads can range from 0.04 to 0.06 inch, or 0.06 to 0.08 inch. In some embodiments, the intermediate thickness for fairway wood-type club heads can range from 0.04 to 0.05 inch, 0.05 to 0.06 inch, 0.06 to 0.07 inch, or 0.07 to 0.08 inch. For example, the intermediate thickness for fairway wood-type club heads can be approximately 0.04, 0.045, 0.05, 0.055, 0.06, 0.065, 0.07, 0.075, or 0.08 inch. In another example, the intermediate thickness for fairway-wood type club heads can be 0.06 inch.

In other embodiments, the intermediate region 166 can extend discontinuously around the striking surface 144. In these embodiments, the intermediate region 166 can comprise one or more intermediate region zones 166 comprising the constant intermediate thickness. For example, the one or more intermediate region zones 166 can comprise one, two, three, four, or five intermediate region zones 166. In these embodiments, the intermediate region 166 may not extend 100% around the striking surface 144. In these embodiments, the intermediate region 166 can extend greater than 50%, greater than 55%, greater than 65%, greater than 70%, greater than 75%, greater than 80%, greater than 85%, greater than 90%, or greater than 95% around the striking surface 144. In other embodiments, the intermediate region 166 can extend 50% to 75%, or 75% to 100%. In other embodiments, the intermediate region 166 can extend 50% to 100%, 60% to 100%, 70% to 100%, 80% to 100%, or 90% to 100% around the striking surface 144. In other embodiments, the intermediate region 166 can extend 50% to 70%, 60% to 80%, 70% to 90%, or 80% to 100% around the striking surface 144.

Figure 11:
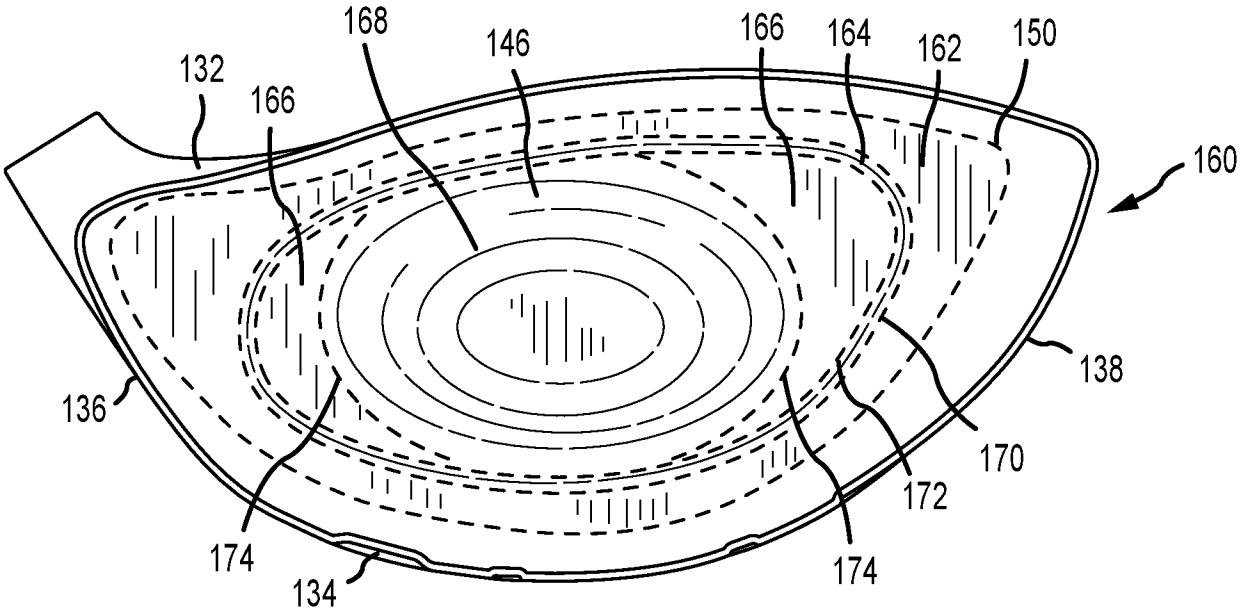
FIG. 11 illustrates a partial cut-away rear perspective view of a golf club head according to another embodiment.

In some embodiments, the thickness of the face 142 between the transition boundary 172 and the intermediate boundary 174, and outside the one or more intermediate region zones 166 can be less than or equal to the constant intermediate thickness of the one or more intermediate region zones 166. In other embodiments, the thickness of the face 142 between the transition boundary 172 and the intermediate boundary 174, and outside the one or more intermediate region zones 166 can be greater than or equal to the constant intermediate thickness of the one or more intermediate region zones 166. The one or more intermediate region zones 166 allow for weight to be removed from the face 142 and to be positioned in other portions of the club head 100 such as the sole 134 to adjust the center of gravity location and improve moment of inertia. Further, the one or more intermediate region zones 166 increase the ball speed for off center golf ball impacts In one example, as illustrated in FIG. 11, the intermediate region 166 can be separated into two intermediate region zones 166 comprising the constant intermediate thickness. The intermediate region zones 166 can be positioned near the toe 138 and the heel 136. More specifically, a first intermediate region zone 166 can extend within the high toe quadrant 120 and the low toe quadrant 124, and a second intermediate region zone 166 can extend within the high heel quadrant 122 and the low heel quadrant 126. In this example, the two intermediate region zones 162 can extend greater than 75% around the striking surface 144.

The intermediate region 166 comprises a surface area on the back surface 146 of the face 142. As illustrated in FIG. 4, the surface area of the intermediate region 166 varies within the high toe quadrant 120, the high heel quadrant 122, the low toe quadrant 124, and the low heel quadrant 126.

The surface area of the intermediate region 166 is greatest in the high toe quadrant 120. The surface area of the intermediate region 166 is smallest in the high heel quadrant 122. The surface area of the intermediate region 166 increases from the low toe quadrant 124 towards the high toe quadrant 120. The surface area of the intermediate region 166 decreases from the high toe quadrant 120 towards the high heel quadrant 122. The surface area of the intermediate region 166 increases from the high heel quadrant 122 towards the low heel quadrant 126. The surface area of the intermediate region 166 is constant from the low heel quadrant 126 towards the low toe quadrant 124.

The thinned constant intermediate thickness increases the ball speed for off center hits. The optimal ball speed occurs near the geometric center of the face 142. The thinned constant intermediate thickness allows for similar ball speed characteristics as the center of the face 142 for locations other than the center. Further, the thinned constant intermediate thickness further increases or maximizes the CT of the face 142. The thinned constant intermediate thickness of the intermediate region 166 in combination with the thickened constant perimeter thickness as described above can provide the club head 100 0.5 to 2.0 greater ball speed and 1% to 5% greater CT compared to a club head devoid of the described thickened and thinned regions.

Central Region

As illustrated in FIGS. 4-6, the thickness of the face 142 varies and is described with reference to one or more regions 160. The one or more regions 160 of the face 142 comprises the central region 168. The central region 168 extends inward toward the geometric center 148 of the face 142 from the intermediate region 166. The central region 168 can encompass the geometric center 148 of the face 142. More specifically, the central region 168 extends inward from the intermediate boundary 174 to the geometric center 148. The central region 168 comprises a central thickness that can vary and/or remain constant. In many embodiments, the central thickness comprises the maximum thickness of the face 142. In many embodiments, the central thickness comprises a varying thickness that increases in a direction from the intermediate region 166 toward the geometric center 148 and a constant thickness positioned over the geometric center 148 of the face 142. In many embodiments, the central region 168 can comprise an elliptical shape. In other embodiments, the central region 168 can comprise a circular shape, a rhombus shape, a quadrilateral shape, an asymmetric elliptical shape, or any other geometric shape.

In many embodiments, the central thickness for driver-type club heads can be less than or equal to 0.20 inch, less than or equal to 0.15 inch, less than or equal to 0.14 inch, less than or equal to 0.13 inch, or less than or equal to 0.12 inch. In other embodiments, the central thickness for driver-type club heads can range from 0.08 to 0.2 inch. In some embodiments, the central thickness for driver-type club heads can range from 0.08 to 0.14 inch, or 0.14 to 0.2 inch. In some embodiments, the central thickness for driver-type club heads can range from 0.08 to 0.12 inch, 0.12 to 0.16 inch, or 0.16 to 0.20 inch. For example, the central thickness for driver-type club heads can be approximately 0.08, 0.085, 0.09, 0.095, 0.10, 0.105, 0.11, 0.115, 0.12, 0.125, 0.13, 0.132, 0.135, 0.14, 0.145, 0.15, 0.16, 0.17, 0.18, 0.19, or 0.20 inch. In another example, the central thickness for driver-type club heads can be 0.132 inch. In another example, the central thickness for driver-type club heads can be 0.136 inch.

In many embodiments, the central thickness for fairway wood-type club heads can be less than or equal to 0.15 inch, less than or equal to 0.10 inch, less than or equal to 0.09 inch, less than or equal to 0.08 inch. In other embodiments, the central thickness for fairway wood-type club heads can range from 0.05 to 0.10 inch. In some embodiments, the central thickness for fairway wood-type club heads can range from 0.05 to 0.075 inch, or 0.075 to 0.10 inch. In some embodiments, the central thickness for fairway wood-type club heads can range from 0.05 to 0.06 inch, 0.06 to 0.07 inch, 0.07 to 0.08 inch, 0.08 to 0.09 inch, or 0.09 to 0.10 inch. For example, the central thickness for fairway wood-type club heads can be approximately 0.05, 0.055, 0.06, 0.065, 0.07, 0.075, 0.08, 0.085, 0.09, 0.095, or 0.10 inch. In another example, the central thickness for fairway wood-type club heads can be 0.075 inch.

In other embodiments, the central region 168 can encompass a geometric center 185 offset from the geometric center 148 of the face 142. The geometric center 185 of the central region 168 can be offset from the geometric center 148 of the face 142 in a direction towards the crown 132, the sole 134, the toe 138, or the heel 136 of the club head 100. In some embodiments, the geometric center 185 of the central region 168 can be offset from the x-axis 105 towards the sole 134 or offset from the x-axis 105 towards the crown 132. In some embodiments, the geometric center 185 of the central region 168 can be offset from the y-axis 110 towards the heel 136 or offset from the y-axis 110 towards the toe 138.

Further, an offset distance can be measured from the geometric center 148 of the face 142 to the geometric center 185 of the central region 168 in a direction parallel to the loft plane 118. In many embodiments, the offset distance between the geometric center 148 of the face 142 and the geometric center 185 of the central region 168 can range from 0 to 0.2 inch. In some embodiments, the offset distance can range from 0 to 0.1 inch, or 0.1 to 0.2 inch. In some embodiments, the offset distance can range from 0 to 0.05 inch, 0.05 to 0.1 inch, 0.1 to 0.15 inch, or 0.15 to 0.20 inch. For example, the offset distance can be 0, 0.05, 0.06, 0.07, 0.08, 0.09, 0.1, 0.11, 0.12, 0.13, 0.14, 0.15, or 0.20 inch. In another example, the offset distance for driver-type club heads can be 0.06 inch. In another example, the offset distance for fairway wood-type club heads can be 0.05 inch.

Figure 12:
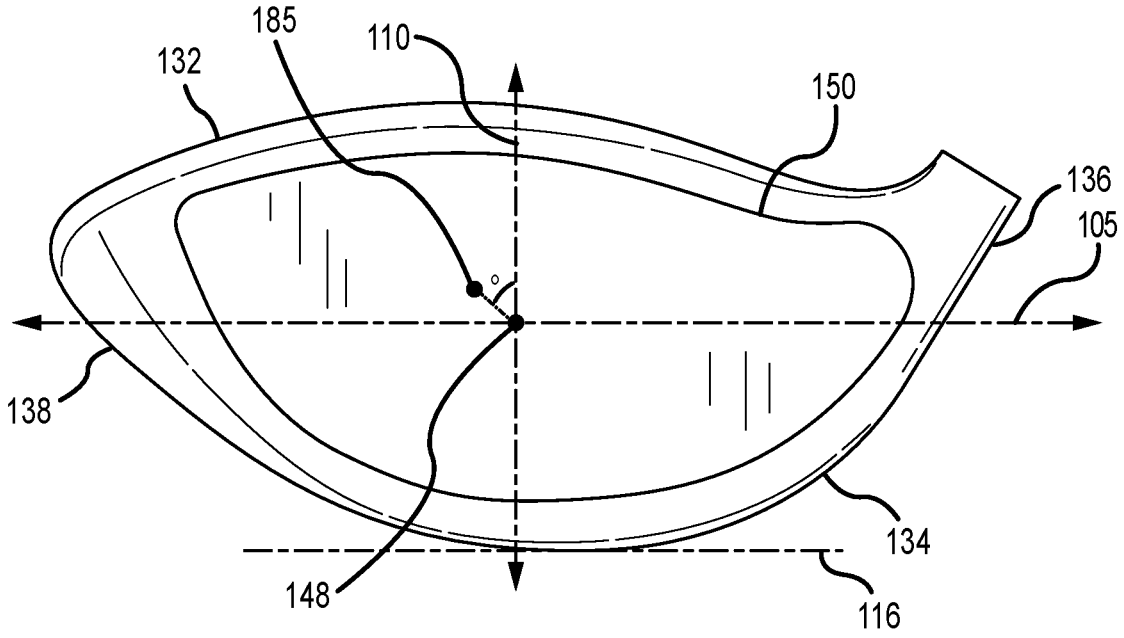
FIG. 12 illustrates a front view of a golf club head according to another embodiment.

In many embodiments, the geometric center 185 of the central region 168 can be vertically offset (i.e. sole or crown direction) from the geometric center 148 of striking surface 144. In some embodiments, the geometric center 185 of the central region 168 can be horizontally offset (i.e. heel or toe direction) from the geometric center 148 of the striking surface 144. In other embodiments, as illustrated in FIG. 12, the geometric center 185 of the central region 168 can be offset from the geometric center 148 of the face 142 at an angle to the y-axis 110. The offset angle of the geometric center 185 of the central region 168 can be measured from the y-axis 110 to a line extending through the geometric center 148 of the face 142 and the geometric center 185 of the central region 168. In many embodiments, the offset angle can range from 0 to 10 degrees. In some embodiments, the offset angle can range from 0 to 5 degrees, or 5 degrees to 10 degrees. In some embodiments, the offset angle can range from 0 to 2 degrees, 2 to 4 degrees, 4 to 6 degrees, 6 to 8 degrees, or 8 to 10 degrees. For example, the offset angle can be 0, 1, 2, 3, 4, 5, 6, 7, 8, 9, or 10 degrees.

Driver-Type Club Head Advantages

In embodiments of the club head 100 comprising a driver-type club head, the varying thickness of the face 142 provides the advantages of (1) a maximum characteristic time (CT) within the United States Golf Association (USGA) rules, (2) an increase in ball speed for center and off center hits, (3) an increase in the durability in the face 142, and (4) an increase in weight savings in the face 142. The thickened constant perimeter thickness improves the durability in the face 142. In some embodiments, where the perimeter region 162 comprises the weld line 180, the thickness of the face 142 is constant on both sides of the weld line 180 to improve the durability of the region around the weld line 180. The thickened constant perimeter thickness allows the face 142 to be thinned in the intermediate region 166. The thinned constant intermediate thickness increases the ball speed for off center hits and increases the CT of the face 142. The thickened central thickness positioned over the geometric center of the face 142 further increases ball speed and CT for center hits. The combination of the thickened constant perimeter thickness, the thinned constant intermediate thickness, and the thickened central thickness can provide driver-type club heads with 0.5 to 2.0 mph greater ball speed and 1% to 5% greater CT compared to driver-type club heads devoid of the described thickened and thinned regions, and the consistent face thickness on both sides of the weld line. Further, the thinned intermediate region 166 allows for material to be removed from the face 142 and to be positioned in different portions of the club head 100 such as the sole 134 to maximize club head performance (i.e. through center of gravity position and moment of inertia).

Fairway Wood-Type Club Head Advantages

In embodiments of the club head 100 comprising a fairway wood-type club head, the varying thickness of the face 142 provides the advantages of (1) an increase in the durability in the face 142 and the club head 100, and (2) a reduced striking surface 144 height to decrease back spin and increase launch angle of a golf ball during impact. The thickened constant perimeter thickness improves the durability in the face 142. In some embodiments, where the perimeter region 162 comprises the weld line 180, the thickness of the face 142 is constant on both sides of the weld line 180 to improve the durability of the region around the weld line 180. Typically, for fairway wood-type club heads, the fairway wood-type club head fails and cracks at the crown 132 during golf ball impacts. By increasing the constant perimeter thickness near the crown 132, the durability in the face 142 and the rear body portion 130 greatly improve thereby reducing the number cracking failures at the crown 132. The thickened constant perimeter thickness of the face 142 further increases the durability in fairway wood-type club heads that have a large difference in material strength between the front body portion 140 and the rear body portion 130. Typically, when the material strength between the front body portion 140 and the rear body portion 130 is too large, the fairway wood-type club head fails at the rear body portion 130 because the material strength of the rear body portion 130 is lower than the material strength of the front body portion 140. The thickened constant perimeter thickness alleviates failures due to large differences in material strength and provides fairway wood-type club heads with increased durability. The thickened constant perimeter thickness can provide fairway wood-type club heads with 15% to 30% increase in durability compared to fairway wood-type club heads devoid of the thickened constant perimeter thickness and the consistent face thickness on both sides of the weld line.

Further, the increased durability in the face 142 from the constant perimeter thickness allows for a reduced striking surface 144 height. The reduced striking surface 144 height allows the region of the striking surface 144 near the crown 132 to be closer to the ground at impact. Impacts at the region of the striking surface 144 near the crown 132 on fairway wood-type club heads allows for (1) a reduction of back spin, and (2) an increase in launch angle of the golf ball. The reduced striking surface 144 height allows a player to hit higher on the striking surface 144 to achieve the decrease in back spin and the increase in launch angle of the golf ball during impact.

Method of Manufacturing Hollow Body Club Head Having a Face with a Variable Thickness A method of manufacturing a club head 100 having a face 142 with a variable thickness is provided. The method includes providing a front body portion 140 and a rear body portion 130, where the front body portion 140 and the rear body portion 130 are coupled together to define a substantially hollow structure. The rear body portion 130 further having a heel 136, a toe 138 opposite the heel 136, a crown 132, and a sole 134. The method further includes providing the front body portion 140 with a face 142 having a striking surface 144, a back surface 146 opposite the striking surface 144, a geometric center, an outer edge, and a varying thickness. The variable thickness of the face 142 can be formed between the geometric center 148 and the outer edge 150. The club head 100 having the front body portion 140, the rear body portion 130, and the face 142 with the variable thickness can be created or formed by casting, forging, machining, or any suitable method or combination thereof. In some embodiments, the club head 100 can be created or formed by casting the rear body portion 130 and forging the front body portion 140. In some embodiments, the club head 100 can be created or formed by casting the rear body portion 130 and machining the front body portion 140. In some embodiments, the club head 100 can be created or formed by machining both the front body portion 140 and the rear body portion 130. In many embodiments, the front body portion 140 can be welded onto the rear body portion 130 by various welding methods such as laser welding, plasma welding, or other welding methods. In some embodiments, the club head 100 can be created or formed by casting the rear body portion 130, forging the front body portion 140, and welding the front body portion 140 onto the rear body portion 130.

The method of manufacturing the club head 100 described herein is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

EXAMPLES

Example 1—Exemplary Variable Face Thickness for Driver-type Club Head

An exemplary driver-type club head 100 comprises a volume of greater than 400 cc and a face having a variable thickness. The face of the exemplary driver-type club head 100 comprises a perimeter thickness of greater than or equal to 0.09 inch, an intermediate thickness of less than or equal to 0.085 inch, and a central thickness of approximately 0.132 inch. This exemplary driver-type club head 100 achieves the desirable maximum characteristic time within the USGA rules and the increase in ball speed.

Example 2—Exemplary Variable Face Thickness for Driver-Type Club Head

An exemplary driver-type club head 100 comprises a volume of greater than 455 cc and a face having a variable thickness. The face of the exemplary driver-type club head 100 comprises a perimeter thickness of 0.10 inch, an intermediate thickness of 0.082 inch, and a central thickness of 0.136 inch. This exemplary driver-type club head 100 achieves the desirable maximum characteristic time within the USGA rules and the increase in ball speed.

Example 3—Exemplary Variable Face Thickness for Fairway Wood-Type Club Head

An exemplary fairway wood-type club head 100 comprises a volume less than 400 cc and a face having a variable thickness. The face of the exemplary fairway wood-type club 100 comprises a perimeter thickness of 0.07 inch, an intermediate thickness of 0.06 inch, and a central thickness of 0.075 inch. This exemplary fairway wood-type club head 100 achieves the improvement in the durability in the club head, and the reduction in the striking surface height to decrease back spin and increase the launch angle of the golf ball.

Example 4—Durability Test for Fairway Wood-Type Club Head

An exemplary fairway wood-type club head 100 comprising a face having a variable thickness was compared to a similar control fairway wood-type club head comprising a face having a variable thickness, but devoid of a thickened perimeter thickness and a thinned intermediate thickness. The face of the exemplary fairway wood-type club head 100 comprises a perimeter thickness of 0.07 inch, an intermediate thickness of 0.06 inch, and a central thickness of 0.075 inch. The face of the control fairway wood-type club head comprises a perimeter thickness of 0.055 inch, and a central thickness of 0.068 inch.

A test was conducted to compare the durability in the face between the exemplary fairway wood-type club head 100 and the control fairway wood-type club head. The test used an air cannon that fired golf balls at each club head. The distance the air cannon was positioned from each club head was held constant, and each club head was held in an address position (i.e. loft was not added or reduced during the test). The test compared the number of golf ball impacts each club head could endure before failure (e.g. club head cracking). The test resulted in the exemplary fairway wood-type club head 100 averaging 3200 golf ball impacts to failure, and the control fairway wood-type club head averaging 2500 impacts to failure. The results show that the exemplary fairway wood-type club head 100 had on average a 28% increase in durability. By increasing the perimeter thickness and decreasing the intermediate thickness, the durability in the club head greatly improves thereby improving impact performance.

Example 5—Stress Test for Fairway Wood-Type Club Head

An exemplary fairway wood-type club head 100 comprising a face having a variable thickness was compared to a similar control fairway wood-type club head comprising a face having a variable thickness, but devoid of a thickened perimeter thickness and a thinned intermediate thickness. The exemplary fairway wood-type club head 100 and the control fairway wood-type club head comprise a front body portion comprising a C350 steel material having a yield strength of 337 kilo pound force per square inch (ksi), and a rear body portion comprising a 17-4 stainless steel material having a yield strength of 150 ksi. The face of the exemplary fairway wood-type club head 100 comprises a perimeter thickness of 0.07 inch, an intermediate thickness of 0.06 inch, and a central thickness of 0.075 inch. The face of the control fairway wood-type club head comprises a perimeter thickness of 0.055 inch, and a central thickness of 0.068 inch.

A test was conducted to compare locations of highest stress between the exemplary fairway wood-type club head 100 and the control fairway wood-type club head. Specifically, the locations around the weld line and the crown for each club head. The test used finite element simulations that modeled an impact of a golf ball on the striking surface with a ball speed of 115 mph. The test compared the locations throughout the club head that exceeded the yield strength of the material. The test resulted in the exemplary fairway wood-type club head 100 having the highest stresses removed from the weld line and the crown, and the control fairway wood-type club head having the highest stresses in the weld line and the crown. The control fairway wood-type club head exceeded the yield strength of 150 ksi at (1) the weld line near the crown, (2) the weld line near the sole, and (3) the crown of the rear body portion. By increasing the perimeter thickness and decreasing the intermediate thickness, the durability in the club head greatly improves thereby removing the highest stresses away from the weld line and the crown. The removal of the highest stresses from the weld line and the crown improves impact performance and reduces the number of fairway wood-type club head failures.

Example 6—Ball Speed and Characteristic Time Tests for Driver-Type Club Head

Exemplary driver-type club head 100 comprises a face having a variable thickness. Control driver-type club head comprises a face having a variable thickness, but devoid of a thick perimeter region, a thin intermediate region, and a constant face thickness on both sides of the weld line. The face of the exemplary driver-type club head 100 comprises a perimeter thickness of 0.10 inch, an intermediate thickness of 0.082 inch, a central thickness of 0.136 inch, and a constant thickness of 0.10 inch on both sides of the weld line. The face of the control driver-type club head comprises a perimeter thickness of 0.092 inch, a central thickness of 0.142 inch, and a thickness of 0.092 inch on one side of the weld line (i.e. side closer to the geometric center of the face) and a thickness of 0.086 inch on the opposite side of the weld line (i.e. side closer to the outer edge of the striking surface).

The test measures the ball speed and the characteristic time (CT) between the exemplary driver-type club head 100 and the control driver-type club head. The ball speed test entails measuring the ball speed off the striking surface over many golf ball impacts while keeping the club head dimensions, loft angle, shaft characteristics, and weather conditions for each respective club head constant. The characteristic time test entails impacting a specific spot on the striking surface several times using a small steel pendulum. The characteristic time test records the CT in microseconds (μs). Results from the tests show the exemplary driver-type club head 100 averaging 0.5 to 2.0 mph greater ball speed than the control driver-type club head. Further, results from the tests show the exemplary driver-type club head 100 averaging 1% to 5% greater CT than the control driver-type club head. Incorporating the thick perimeter thickness, the thin intermediate region, and the constant face thickness on both sides of the weld line provides the exemplary driver-type club head 100 with increases in CT and ball speed for center and off center hits.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Alternatively, the apparatus, methods, and articles of manufacture described herein may be applicable to other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

Clause 1. A hollow body golf club head comprising: a volume greater than approximately 400 cc; a front body portion; the front body portion having: a face comprising: a striking surface comprising an outer edge, where the outer edge defines a perimeter of the striking surface; a back surface opposite the striking surface; a geometric center; a thickness measured from the striking surface to the back surface; a perimeter region comprising a constant perimeter thickness and extending inward from the outer edge of the face toward a perimeter boundary, where the perimeter boundary defines the locations on the face where the thickness of the face deviates from the constant perimeter thickness; a transition region comprising a varying transition thickness and extending inward from the perimeter boundary toward a transition boundary, where the transition boundary defines the locations on the face where the thickness of the face deviates from the varying transition thickness; an intermediate region comprising a constant intermediate thickness and extending inward from the transition boundary toward an intermediate boundary, where the intermediate boundary defines the locations on the face where the thickness of the face deviates from the constant intermediate thickness; wherein: the intermediate thickness comprises a minimum thickness of the face; the perimeter thickness is greater than the intermediate thickness; a perimeter distance measured from the outer edge of the striking surface to the perimeter boundary is less than or equal to 0.25 inch.

Clause 2. The hollow body club head of clause 1, wherein: the perimeter region further comprises a junction, where a junction distance measured from the outer edge of the striking surface to the junction is less than the perimeter distance, where the thickness of the face is constant on both sides of the junction.

Clause 3. The hollow body club head of clause 2, wherein: the junction distance is less than or equal to 0.20 inch.

Clause 4. The hollow body club head of clause 1, wherein: the perimeter region extends greater than 65% around the outer edge of the striking surface.

Clause 5. The hollow body club head of clause 1, wherein: the perimeter thickness ranges from 0.06 to 0.16 inch; and the intermediate thickness ranges from 0.05 to 0.10 inch.

Clause 6. The hollow body club head of clause 1, wherein: the perimeter thickness is greater than or equal to 0.09 inch; and the intermediate thickness is less than or equal to 0.085 inch.

Clause 7. A hollow body golf club head comprising: a volume less than approximately 400 cc; a front body portion; the front body portion having: a face comprising: a striking surface comprising an outer edge, where the outer edge defines a perimeter of the striking surface; a back surface opposite the striking surface; a geometric center; a thickness measured from the striking surface to the back surface; a perimeter region comprising a constant perimeter thickness and extending inward from the outer edge of the face toward a perimeter boundary, where the perimeter boundary defines the locations on the face where the thickness of the face deviates from the constant perimeter thickness; a transition region comprising a varying transition thickness and extending inward from the perimeter boundary toward a transition boundary, where the transition boundary defines the locations on the face where the thickness of the face deviates from the varying transition thickness; an intermediate region comprising a constant intermediate thickness and extending inward from the transition boundary toward an intermediate boundary, where the intermediate boundary defines the locations on the face where the thickness of the face deviates from the constant intermediate thickness; wherein: the intermediate thickness comprises a minimum thickness of the face; the perimeter thickness is greater than the intermediate thickness; a perimeter distance measured from the outer edge of the striking surface to the perimeter boundary is less than or equal to 0.25 inch.

Clause 8. The hollow body club head of clause 7, wherein: the perimeter region further comprises a junction, where a junction distance measured from the outer edge of the striking surface to the junction is less than the perimeter distance, where the thickness of the face is constant on both sides of the junction.

Clause 9. The hollow body club head of clause 8, wherein: the junction distance is less than or equal to 0.20 inch.

Clause 10. The hollow body club head of clause 7, wherein: the perimeter region extends greater than 65% around the outer edge of the striking surface.

Clause 11. The hollow body club head of clause 7, wherein: the perimeter region extends greater than 90% around the outer edge of the striking surface.

Clause 12. The hollow body club head of clause 7, wherein: the perimeter thickness ranges from 0.05 to 0.10 inch; and the intermediate thickness ranges from 0.04 to 0.08 inch.

Clause 13. The hollow body club head of clause 7, wherein: the perimeter thickness is greater than or equal to 0.065 inch; and the intermediate thickness is less than or equal to 0.065 inch.

Clause 14. A hollow body golf club head comprising: a front body portion; the front body portion having: a face comprising: a striking surface comprising an outer edge, where the outer edge defines a perimeter of the striking surface; a back surface opposite the striking surface; a geometric center; a thickness measured from the striking surface to the back surface; a perimeter region comprising a constant perimeter thickness, and extending inward from the outer edge of the face toward a perimeter boundary, where the perimeter boundary defines the locations on the face where the thickness of the face deviates from the constant perimeter thickness; a transition region comprising a varying transition thickness and extending inward from the perimeter boundary toward a transition boundary, where the transition boundary defines the locations on the face where the thickness of the face deviates from the varying transition thickness; an intermediate region comprising a constant intermediate thickness and extending inward from the transition boundary toward an intermediate boundary, where the intermediate boundary defines the locations on the face where the thickness of the face deviates from the constant intermediate thickness; an elliptical central region encompassing a geometric center of the face, the central region comprising a varying central thickness and extending inward from the intermediate boundary toward the geometric center of the central region; wherein: the intermediate thickness comprises a minimum thickness of the face; the central thickness comprises a maximum thickness of the face; the perimeter thickness is greater than the intermediate thickness and less than the central thickness; a perimeter distance measured from the outer edge of the striking surface to the perimeter boundary is less than or equal to 0.25 inch.

Clause 15. The hollow body club head of clause 14, wherein: the perimeter region further comprises a junction, where a junction distance measured from the outer edge of the striking surface to the junction is less than the perimeter distance, where the thickness of the face is constant on both sides of the junction.

Clause 16. The hollow body club head of clause 15, wherein: the junction distance is less than or equal to 0.20 inch.

Clause 17. The hollow body club head of clause 14, wherein: the perimeter region extends greater than 60% around the outer edge of the striking surface.

Clause 18. The hollow body club head of clause 14, wherein: the perimeter thickness ranges from 0.06 to 0.16 inch; and the intermediate thickness ranges from 0.05 to 0.10 inch.

Clause 19. The hollow body club head of clause 14, wherein: the perimeter thickness ranges from 0.05 to 0.10 inch; and the intermediate thickness ranges from 0.04 to 0.08 inch.

Clause 20. The hollow body club head of clause 14, wherein: the central region comprises a geometric center offset from the geometric center of the face.

The invention claimed is:

1. A hollow body golf club head comprising:
a volume greater than approximately 400 cc;
a front body portion;
the front body portion having:
a face comprising:
a striking surface comprising an outer edge, where the outer edge defines a perimeter of the striking surface;
a back surface opposite the striking surface;
a geometric center;
a thickness measured from the striking surface to the back surface;
a perimeter region comprising a constant perimeter thickness and extending inward from the outer edge of the face toward a perimeter boundary, where the perimeter boundary defines the locations on the face where the thickness of the face deviates from the constant perimeter thickness;
a transition region comprising a varying transition thickness and extending inward from the perimeter boundary toward a transition boundary, where the transition boundary defines the locations on the face where the thickness of the face deviates from the varying transition thickness;
an intermediate region comprising a constant intermediate thickness and extending inward from the transition boundary toward an intermediate boundary, where the intermediate boundary defines the locations on the face where the thickness of the face deviates from the constant intermediate thickness;
wherein:
the intermediate thickness comprises a minimum thickness of the face;
the perimeter thickness is greater than the intermediate thickness;
a perimeter distance measured from the outer edge of the striking surface to the perimeter boundary is less than or equal to 0.25 inch;
the intermediate region comprises a variable surface area a length of the intermediate region is measured from the transition boundary to the intermediate boundary along a line extending radially from the geometric center of the face; and the length of the intermediate region is greatest in a high toe quadrant of the face compared to the length of the intermediate region in the other quadrants of the face.

2. The hollow body club head of claim 1, wherein:
the perimeter region further comprises a junction, where a junction distance measured from the outer edge of the striking surface to the junction is less than the perimeter distance, where the thickness of the face is constant on both sides of the junction.

3. The hollow body club head of claim 2, wherein:
the junction distance is less than or equal to 0.20 inch.

4. The hollow body club head of claim 1, wherein:
the perimeter region extends greater than 65% around the outer edge of the striking surface.

5. The hollow body club head of claim 1, wherein:
the perimeter thickness ranges from 0.06 to 0.16 inch; and
the intermediate thickness ranges from 0.05 to 0.10 inch.

6. The hollow body club head of claim 1, wherein:
the perimeter thickness is greater than or equal to 0.09 inch; and
the intermediate thickness is less than or equal to 0.085 inch.

7. A hollow body golf club head comprising:
a front body portion;
the front body portion having:
a face comprising:
a striking surface comprising an outer edge, where the outer edge defines a perimeter of the striking surface;
a back surface opposite the striking surface;
a geometric center;
a thickness measured from the striking surface to the back surface;
a perimeter region comprising a constant perimeter thickness, and extending inward from the outer edge of the face toward a perimeter boundary, where the perimeter boundary defines the locations on the face where the thickness of the face deviates from the constant perimeter thickness;

a transition region comprising a varying transition thickness and extending inward from the perimeter boundary toward a transition boundary, where the transition boundary defines the locations on the face where the thickness of the face deviates from the varying transition thickness;

an intermediate region comprising a constant intermediate thickness and extending inward from the transition boundary toward an intermediate boundary, where the intermediate boundary defines the locations on the face where the thickness of the face deviates from the constant intermediate thickness;

an elliptical central region encompassing the geometric center of the face, the central region comprising a varying central thickness and extending inward from the intermediate boundary toward the geometric center of the face;

wherein:

the intermediate thickness comprises a minimum thickness of the face;

the central thickness comprises a maximum thickness of the face;

the perimeter thickness is greater than the intermediate thickness and less than the central thickness;

a perimeter distance measured from the outer edge of the striking surface to the perimeter boundary is less than or equal to 0.25 inch;

the intermediate region comprises a variable surface area a length of the intermediate region is measured from the transition boundary to the intermediate boundary along a line extending radially from the geometric center of the face; and the length of the intermediate region is greatest in a high toe quadrant of the face compared to the length of the intermediate region in the other quadrants of the face.

8. The hollow body club head of claim 7, wherein:

the perimeter region further comprises a junction, where a junction distance measured from the outer edge of the striking surface to the junction is less than the perimeter distance, where the thickness of the face is constant on both sides of the junction.

9. The hollow body club head of claim 8, wherein:

the junction distance is less than or equal to 0.20 inch.

10. The hollow body club head of claim 7, wherein:

the perimeter region extends greater than 60% around the outer edge of the striking surface.

11. The hollow body club head of claim 7, wherein:

the perimeter thickness ranges from 0.06 to 0.16 inch; and the intermediate thickness ranges from 0.05 to 0.10 inch.

12. The hollow body club head of claim 7, wherein:

the perimeter thickness ranges from 0.05 to 0.10 inch; and the intermediate thickness ranges from 0.04 to 0.08 inch.

13. The hollow body club head of claim 7, wherein:

the central region comprises a geometric center offset from the geometric center of the face.

* * * * *